US008636605B2

(12) United States Patent
Rose

(10) Patent No.: US 8,636,605 B2
(45) Date of Patent: Jan. 28, 2014

(54) IR SYSTEM FOR KINEMATIC ANALYSIS

(75) Inventor: Gregory Alan Rose, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 1555 days.

(21) Appl. No.: 11/364,343

(22) Filed: Mar. 1, 2006

(65) Prior Publication Data

US 2007/0207873 A1 Sep. 6, 2007

(51) Int. Cl.
*A63B 57/00* (2006.01)

(52) U.S. Cl.
USPC ..... 473/266; 473/207

(58) Field of Classification Search
USPC ..... 473/207, 209, 215, 266
See application file for complete search history.

(56) References Cited

U.S. PATENT DOCUMENTS

| | | | | |
|---|---|---|---|---|
| 5,067,717 | A * | 11/1991 | Harlan et al. | 473/209 |
| 5,221,088 | A * | 6/1993 | McTeigue et al. | 473/201 |
| 5,592,401 | A * | 1/1997 | Kramer | 702/153 |
| 5,930,741 | A * | 7/1999 | Kramer | 702/153 |
| 6,050,962 | A * | 4/2000 | Kramer et al. | 600/595 |
| 6,148,280 | A * | 11/2000 | Kramer | 702/153 |
| 6,176,816 | B1 * | 1/2001 | Dicker et al. | 482/124 |
| 6,261,189 | B1 * | 7/2001 | Saville et al. | 473/221 |
| 6,402,636 | B1 * | 6/2002 | Chang | 473/324 |
| 6,428,490 | B1 * | 8/2002 | Kramer et al. | 600/595 |
| 6,488,591 | B1 | 12/2002 | Gobush et al. | 473/199 |
| 6,500,073 | B1 | 12/2002 | Gobush et al. | 473/199 |
| 6,533,674 | B1 | 3/2003 | Gobush | 473/199 |
| 6,612,845 | B1 * | 9/2003 | Macri et al. | 434/247 |
| 6,758,759 | B2 | 7/2004 | Gobush et al. | 473/131 |
| 6,764,412 | B2 | 7/2004 | Gobush et al. | 473/199 |
| 6,781,621 | B1 | 8/2004 | Gobush et al. | 348/157 |
| 2003/0083596 | A1 * | 5/2003 | Kramer et al. | 600/595 |
| 2004/0259651 | A1 * | 12/2004 | Storek | 473/131 |
| 2005/0143183 | A1 * | 6/2005 | Shirai et al. | 473/151 |
| 2005/0215335 | A1 * | 9/2005 | Marquardt | 473/131 |
| 2005/0215336 | A1 * | 9/2005 | Ueda et al. | 473/131 |
| 2005/0215337 | A1 * | 9/2005 | Shirai et al. | 473/151 |
| 2005/0239548 | A1 * | 10/2005 | Ueshima et al. | 463/36 |
| 2005/0255932 | A1 * | 11/2005 | Erickson et al. | 473/266 |
| 2005/0272517 | A1 * | 12/2005 | Funk et al. | 473/222 |
| 2006/0025229 | A1 * | 2/2006 | Mahajan et al. | 473/131 |
| 2006/0040757 | A1 * | 2/2006 | Rosselli | 473/207 |
| 2006/0166737 | A1 * | 7/2006 | Bentley | 463/30 |

OTHER PUBLICATIONS

Pearson, John. "TaylorMade Performance Lab". Nov. 18, 2005. <http://www.publinksgolfer.net/articles/154/1/bTaylorMade-Performance-Labb/Page1.html>.*

(Continued)

*Primary Examiner* — Seng H Lim
(74) *Attorney, Agent, or Firm* — Smith, Gambrell & Russell, LLP

(57) ABSTRACT

A infrared method and apparatus for the kinematic analysis of a golfer is disclosed. The method includes selectively positioning a plurality of infrared markers on a golfer, and optionally on a golf club. Images of the golfer may be acquired before, during, and after he/she swings the golf club. The images may be analyzed to determine the kinematic characteristics of the movement of the golfer's body parts. A kinematic analysis of the golfer's body parts may then be correlated with a kinematic analysis of the golf club. The method and apparatus disclosed herein provide the advantage of allowing a golfer's movement to be correlated with a kinematic analysis of their golf swing while minimizing the physical restrictions on the golfer's movement.

21 Claims, 5 Drawing Sheets

(56) References Cited

OTHER PUBLICATIONS

U.S. Appl. No. 11/228,349.
Kevin Adams, *Golfweek*, "Two Approaches Aim for Similar Results," pp. 14-16, (Mar. 4, 2006).
James Achenbach, *Golfweek*, "Titleist Performance Institute See Fitness Ball Rolling," p. 15 (Mar. 4, 2006).
Jeff Rude, *Golfweek*, "Lehman's Loss Also His Gain," p. 16 (Mar. 4, 2006).
James Achenbach, *Golfweek*, "Options Abound in Search for Perfect Fit," p. 36-37 (May 28, 2005).
James Achenbach, *Golfweek*, "Clubfitting of Tomorrow," p. 37 (May 28, 2005).
Mark S. Murphy, *Golf World Business*, "Turning Data into Feel," p. 12 (Apr. 8, 2005).
Jerry Potter, *USA Today*, "Swing Helper Built for Quick Learning—Matt is costly but effective" (Dec. 10, 2004).
U.S. Appl. No. 11/228,349, filed Sep. 19, 2005.
U.S. Appl. No. 10/861,443, filed Jun. 7, 2004 entitled "Launch Monitor".

* cited by examiner

IR SYSTEM FOR KINEMATIC ANALYSIS

FIELD OF THE INVENTION

The present invention relates to an infrared apparatus and method for kinematic analysis. More specifically, the present invention relates to an apparatus and method that uses infrared markers to correlate the body movement of a golfer with a kinematic analysis of their club swing and ball trajectory.

BACKGROUND OF THE INVENTION

Over the past few decades, the infrared (IR) spectrum has been exploited by a variety of technologies. Examples of applications in which the IR spectrum has been used include night vision, thermography, heating, communications, and spectroscopy. The myriad of applications in which the IR spectrum has been exploited has lead to increased research and advances in technology with which it can be used.

At the same time, computers have become increasingly sophisticated, allowing IR technology to be used to monitor and digitize the motion of various objects, and even people. In particular, this technology has been applied to video and computer games. For instance, many professional athletes allow their image and/or likeness to be used with a particular video or computer game. In order to enhance the experience for the player, characters that look and move like the athlete are often desired. To increase the lifelike appearance of a character, it is often desirable to acquire a digital representation of the athlete in motion, which can then be transferred and stored on a computer. One way that this has been accomplished is by strategically placing IR markers on the body of the athlete, and then acquiring images of the markers using a camera or other image acquisition device.

The use of IR markers is not limited to games. In the field of golf, for example, IR markers have been used in combination with launch monitors. Launch monitors are devices that are capable of performing a kinematic analysis of golf equipment, such as a golf club and/or golf ball. In this application, several IR markers may be placed on the golf club and/or golf ball and images of light reflected by the IR markers are acquired using a camera. Subsequently, the images can be analyzed to determine the kinematics of the golf club, e.g., club speed, face angle, droop angle, launch angle, and the kinematics of the golf ball, e.g., trajectory, velocity, side spin, back spin, and the duration of impact. One drawback to prior art launch monitors that use IR markers is that the analysis is limited to the kinematics of the golf club and/or golf ball.

Each golfer has a unique body movement during their swing, and the differences between various golfers can often vary considerably. In fact, the proper body movement of a golfer can make the difference between a good swing and a bad swing, which in turn affects the ball trajectory. Because of the correlation between body movement and the club swing, golf manufacturers realized a need for a device that could track a golfer's body movement. To satisfy this need, they have employed a variety of electromechanical devices. One device consists of an electromechanical "suit" that includes numerous sensors and mechanical components that are connected to a computer. During the golfer's swing, the electromechanical suit allows the motion of the golfer to be determined, and subsequently digitized.

Though the use of an electromechanical suit allows a golfer's body movement to be determined, this approach has drawbacks. A prominent disadvantage of this device is that a golfer's body movement is frequently impeded by wearing the electromechanical suit, both by the weight of the suit and its mechanical and electrical parts. As a result, a golfer's body movement and swing may differ from their normal body movement and swing. Of course, any analysis of the golfers body motion, or a kinematic analysis of the golf club and/or ball, will be adversely affected as well.

Therefore, a continuing need exists for a method and apparatus for determining and digitizing a golfer's body movement without causing the golfer's movement to be restricted. In addition, a continuing need exists for a method and apparatus that is capable of correlating a golfer's body movement with a kinematic analysis of a golf club and/or golf ball.

SUMMARY OF THE INVENTION

According to one aspect of the present invention, a method for analyzing a golfer's body movement is disclosed. The method includes selectively positioning a plurality of markers on a golfer and acquiring a first set of one or more images of the golfer. Preferably, the images are acquired when the golfer is substantially motionless. Then, some of the plurality of markers are preferably removed from the golfer. A second set of one or more images of a golfer may then be acquired. During the second set of image acquisition, the golfer is in motion at least part of the time. The movement of two or more body parts of the golfer may then be compared using the second set of one or more images.

In one embodiment, the selectively positioning of the markers comprises at least one of selectively positioning a plurality of infrared markers at the joints and the rigid body parts of the golfer and selectively positioning one or more infrared markers on at least one of a golf club and a golf ball. The removing of the markers, described above, may comprise removing the infrared markers positioned at golfer's joints.

It is desirable for the acquisition of the first set of one or more images to include acquiring one or more images of the golfer in a plurality of predetermined, fixed positions. This step further includes using the one or more acquired images to determine the relationship between the golfer's joints and the rigid body parts of the golfer. The acquisition of the second set of one or more images may include having the golfer swing the golf club one or more times, and acquiring images of at least one of the golfer and the golf club before, during, and after the one or more golf club swings.

It is preferable for the comparison of the two or more body parts to comprise analyzing the second set of acquired images to determine the movement of two or more of the golfer's body parts and determining the correlation between the movement of the two or more body parts and the one or more swings by the golfer. Determining the correlation between the movement may lead to determining at least one of: the timing of the movement of the golfer's body parts; the translation of the golfer's body parts; the rotational velocity of the golfer's body parts; and the speed of the golfer's body parts.

According to another aspect of the present invention, a method for performing a kinematic analysis of a golfer's body is disclosed. The method includes selectively positioning a plurality of infrared markers on a golfer and acquiring images of the golfer. At least some of the images are acquired when the golfer is substantially motionless and at least some of the images are acquired when the golfer is in motion. Then, the acquired images may be used to analyze the kinematics of one or more body parts of the golfer. Finally, the kinematics of one or more of the golfer's body parts may be correlated with the kinematics of at least one of a golf club and a golf ball.

According to this aspect, one or more infrared markers are selectively positioned on at least one of the golf club and the golf ball. Additionally, one or more markers may be positioned on the back of the golfer. Images may then be acquired of the golfer before, during, and after two or more golf club swings. The images may be analyzed to determine the motion of the golfer's one or more body parts relative to one another. The motion of the golfer's one or more body parts and the resulting motion of the golf club for each of the two or more golf club swings may then be correlated and compared. Preferably, the comparison allows several aspects of the players movement to be analyzed, including the effect of the timing of the movement of the golfer's body parts on the golf club swing, the effect of the translation of the golfer's body parts on the golf club swing, the effect of the rotational velocity of the golfer's body parts on the golf club swing, and the effect of the speed of the golfer's body parts on the golf club swing.

According to yet another aspect of the present invention, an apparatus for correlating a golfer's body movement with a golf club swing is disclosed. The apparatus includes a plurality of infrared markers selectively positioned on the golfer and the golf club and an image acquisition device capable of imaging light reflected by the infrared markers. In addition, a light generator capable of projecting infrared light onto the plurality of infrared markers is also included. It is also desirable to include a processor for correlating the movement of different parts of the golfer's body with a kinematic analysis of the golf club based on the infrared markers.

In one embodiment, the plurality of infrared markers are selectively positioned on the golfer or golf club using either double-sided tape, an elastic band, or both. About 45 infrared markers, or greater, may be used. Preferably, the image acquisition device comprises a digital camera including a charge-coupled device. It is desirable for the camera to be capable of acquiring at least about 500 frames/second or greater. More preferably, the camera is capable of acquiring at least about 1000 frames/second or greater. Optionally, the apparatus may further include at least two force plates, between about 4 and about 12 cameras, a protective shield, a display device, and an input device.

According to another embodiment of the present invention, a method for performing a kinematic analysis of a golfer's body is disclosed. The method includes selectively positioning a plurality of markers on a golfer and a golf club. Images of the plurality of markers before and after the golfer swings the golf club are then acquired. Preferably, the acquisition is performed when the golfer swings the golf club two or more times. The acquired images of the plurality of markers may be used to determine the correlation between the movement of the golfer's body parts and the golfer's club swings. In one embodiment, the markers comprise infrared markers.

Preferably, the acquiring of images includes acquiring images of the golfer when the golfer is substantially motionless. The relationship between the golfer's body parts may be determined using the acquired images. It is then desirable to remove some of the infrared markers. A second set of images of the golfer may then be acquired before, during, and after the golfer swings the golf club.

The acquired images may be used to correlating the movement of the golfer's body parts with the movement of the golf club. The correlation for each of the two or more golf club swings may then be compared. Alternately, the acquired images may be used to correlate the movement of the golfer's body parts with the movement of the golf club to yield golfer data. The golfer's data may then be compared with an ideal golfer's data. In either case, it is desirable for the comparison to allow information about the golfer to be determined, including the effect of the timing of the movement of the golfer's body parts on the golf club swing, the effect of the translation of the golfer's body parts on the golf club swing, the effect of the rotational velocity of the golfer's body parts on the golf club swing, or the effect of the speed of the golfer's body parts on the golf club swing.

BRIEF DESCRIPTION OF THE DRAWINGS

Further features and advantages of the invention can be ascertained from the following detailed description that is provided in connection with the drawings described below.

DETAILED DESCRIPTION OF THE PREFERRED EMBODIMENTS

Figure 1:
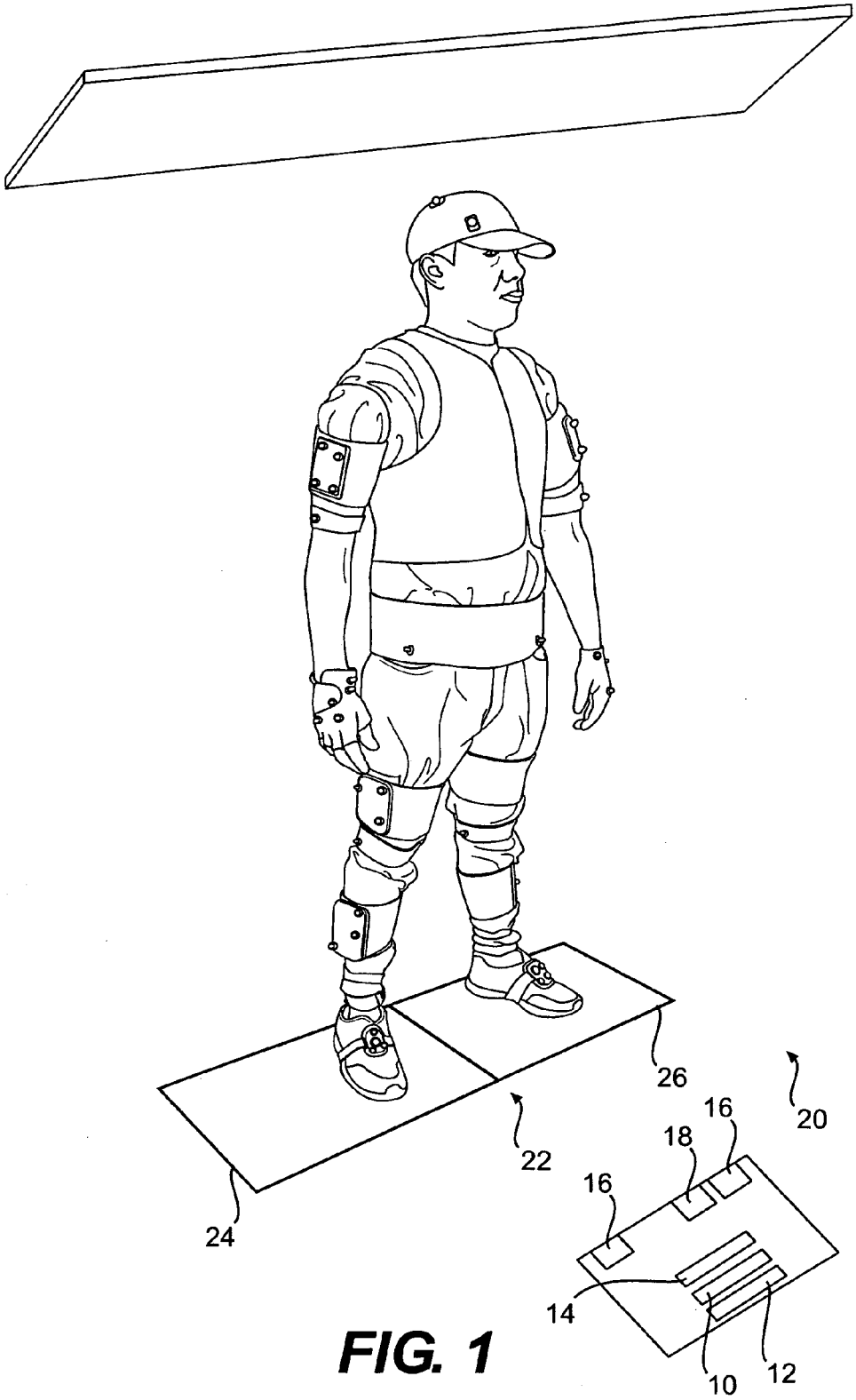
FIG. 1 is a diagram showing a platform according to one embodiment of the present invention.

The majority of sports involves an athlete and requires some type of physical movement. This physical movement is often used to influence equipment, e.g., a tennis racket and ball, a soccer ball, a basketball, or a golf club and golf ball. In each sport, therefore, an athlete's physical movement is of utmost importance. In order to allow an athlete to improve his/her body movement, it is often desirable to track the athlete's movement in order to determine its effect on the equipment of their particular sport. Performing this type of analysis allows the athlete's movement to be analyzed to determine how it can be changed or otherwise modified to increase efficiency, obtain optimal results, or reduce the risk of injury.

In golf, for example, a player's body movement affects the swing of the golf club, and the resultant trajectory of the ball. Specifically, the movement of a player's body parts, e.g., the waist, wrists, arms, knees, and shoulders, can affect the swing. Additionally, the timing of the movement of each body part is extremely important to produce an ideal swing. Thus, it is desirable to monitor the movement of a golfer's body in order to correlate that movement with a kinematic analysis of the golf club and/or golf ball. In this manner, a golfer's movement may be analyzed to determine how it can be corrected or improved.

Therefore, the present invention provides a method and apparatus for measuring the physical movement of an athlete. This may be accomplished through the use of IR markers that are selectively positioned on one or more portions of the athlete's body and/or equipment. An illumination device and image acquisition device may then be used to capture and record images of the athlete at rest, and in motion. The images may be analyzed using a processing device that is capable of digitizing and analyzing the motion of the athlete's various body parts. Preferably, the motion of the body parts is correlated with a kinematic analysis of the equipment that the athlete is using. Performing this correlation allows the athlete to modify or correct their body movement to obtain optimal results.

Though the present invention is described below with respect to a golfer and golf equipment, it is not intended to be limited to any particular sport or type of athletic equipment. Instead, the present invention is capable of being applied to any sport that involves an athlete's body movement. Examples of such sports include, but are not limited to, basketball, football, soccer, tennis, racquetball, squash, and baseball. Moreover, though the present invention is described with respect to IR markers, the present invention may be used with retroreflective markers or limited spectrum markers, e.g., fluorescent markers, as desired for a particular application.

According to one aspect, the present invention may be used in combination with a launch monitor that can determine the kinematics of golf equipment. Any launch monitor known to those skilled in the art may be used. For example, the launch monitors disclosed in U.S. Pat. Nos. 6,488,591, 6,500,073, 6,533,674, 6,781,621, 6,764,412, and 6,758,759, and U.S. patent application Ser. No. 10/861,443, the entireties of which are incorporated herein by reference, may be used in combination with the present invention. Skilled artisans will recognize that the present invention may be a separate element, or it may be included with any launch monitor known to those skilled in the art.

FIG. 1 is a diagram showing an exemplary set-up according to one aspect of the present invention. The present invention preferably includes a processor 10, an input device 12, e.g. a keyboard, and a display device 14, e.g., an LCD screen. The processor 10 may run any operating system and any software known to those skilled in the art. Moreover, any processor, keyboard, or display device known to those skilled in the art may be used. The processor 10 may be operatively connected to each element of the present invention, e.g. the imaging units and IR light generators described below. The present invention also comprises a trigger that detects movement, and a timer that determines the timing of image acquisition, i.e., when to begin and end the acquisition of images and the duration of time between images.

It is desirable for the present invention to include one or more image acquisition devices 16. In one embodiment, the image acquisition devices 16 may comprise cameras. It is preferred that the camera includes an electronic sensor or chip for capturing images. The electronic sensor or chip records light that falls on it. These types of sensors are typically found in digital cameras. Such a camera system may be used according to the present invention in order to obtain high quality images. The electronic sensor or chip may be selectively activated or deactivated at desired intervals in order to obtain two or more time-spaced images. Of course, it is desirable for the camera to be capable of acquiring images of light from within the IR spectrum, though the camera does not have to be limited to acquiring light only within this spectrum.

In a preferred embodiment, the cameras are able to take multiple images of the golfer's body, golf club, and golf ball, both when they are motionless, as well as when they are in motion. This may be accomplished by using a variety of methods. Preferably, a multi-frame method may be employed. This method is well known to those skilled in the art, and involves taking multiple images in different frames and then analyzing each of the separate frames.

More preferably, a method that uses multiple strobing in a single frame may be used. In one example of such a method, the shutter of the camera is maintained in an open position for a desired period of time. While the shutter is open, the charge coupled device (CCD) of the camera is maintained in an activated state so that the camera is able to acquire multiple images on the same frame. This method is analogous to using an analog camera that uses film with low sensitivity and maintains the shutter of the camera in an open position. Because the shutter is continuously open, multiple images may be acquired onto the same frame by using the strobing light.

Most preferably, a multishutter system is employed. Multishutter cameras typically include an electronic shutter that allows the camera to take multiple shutter exposures within a frame to capture high speed events. In a multishutter system, the camera shutters by activating and deactivating the pixel elements of the CCD sensor. The camera also includes a CCD that may be selectively activated. At desired intervals, the CCD of the camera may be activated and deactivated in order to acquire images on the same frame. A multishutter camera allows multiple images to be acquired in one frame while minimizing the amount of background noise present in the frame.

It may be desirable for each camera to be capable of acquiring images at high speeds. One advantage of using one or more high speed cameras is that more accurate calculations may be performed. Another advantage of using one or more high speed cameras is that the chances of acquiring blurred images may be decreased. In one embodiment, the present invention may include dedicated cameras, i.e., one or more cameras may be focused on the golfer, while one or more other cameras may be focused on the golf club and/or golf ball. Preferably, a camera focused on the golfer is capable of acquiring images at about 250 frames/second or greater. More preferably, a camera focused on the golfer is capable of acquiring images at about 500 frames/second or greater. Most preferably, a camera focused on the golfer is capable of acquiring images at about 1000 frames/second or greater. A camera focused on the golf club and/or golf ball is preferably capable of acquiring images at about 750 frames/second or greater. More preferably, cameras focused on the golf club and/or golf ball are capable of acquiring images at about 1000 frames/second or greater. Most preferably, cameras focused on the golf club and/or golf ball are capable of acquiring images at about 1500 frames/second or greater.

In one embodiment, the number of cameras that are included may be varied according to a particular application. For example, if it is desirable to perform a two-dimensional analysis of the golfer's body motion, a smaller number of cameras may be desired. On the other hand, if a three-dimensional analysis of the golfer's body motion is desired, the number of cameras that are desired may increase. Therefore, when a two-dimensional analysis of a golfer is performed, between about 2 and about 8 cameras may be preferred. More preferably between about 4 and about 6 cameras may be used. When a three-dimensional analysis of a golfer is desired, between about 6 and about 14 cameras are preferably used. More preferably, a three-dimensional analysis employs between about 8 and about 12 cameras. Most preferably, a three-dimensional analysis employs between about 9 and about 11 cameras.

According to one aspect of the present invention, one or more devices capable of generating light within the IR spectrum are included. For example, the devices may comprise one or more IR illuminators 18. The IR illuminators 18 are preferably positioned such that they are capable of illuminating a predetermined field of view. The field of view is preferably large enough that all of the IR markers placed on a golfer positioned within the field of view can be illuminated. In some applications it may also be desirable to illuminate IR markers that are selectively positioned on the golf club and/or golf ball. Though it may be desired in some applications, it may not be necessary for a single IR illuminator 18 to be capable of illuminating all of the IR markers. Rather, two or more IR illuminators 18 may be combined to fully cover a desired field of view.

Preferably, the IR illuminators 18 are capable of illuminating a field of view that is about 6'×2' or greater. More preferably, the IR illuminators 18 are capable of illuminating a field of view that is about 7'×3' or greater. Most preferably, the IR illuminators 18 are capable of illuminating a field of view that is about 10'×6' or greater.

The number of IR markers that are used may also be varied. In one embodiment the number of markers may vary depending on whether a static calibration or a kinematic analysis, described in detail below, is being performed. For instance, when a static calibration is being performed, between about 50 and about 200 markers may be used. More preferably, between about 75 and about 150 markers may be used for a static calibration. Most preferably, between about 100 and about 120 markers may be used for a static calibration. When a kinematic analysis is performed the number of markers may be decreased. Preferably, between about 10 and about 100 markers may be used for a kinematic analysis. More preferably, between about 25 and about 75 markers may be used for a kinematic analysis. Most preferably, between about 40 and about 60 markers may be used for a kinematic analysis.

It is desirable for the markers to comprise any desired physical properties. For example, the markers may comprise any shape, e.g., circular, spherical, square, rectangular, and triangular. In addition, the markers may comprise any size or volume. Further, the markers may be visible or invisible to the human eye. Invisible markers may be desired, for example, to reduce the distraction presented to a golfer. Those skilled in the art will understand that the physical properties of the markers, e.g., shape, size, and color, may be chosen to minimize the distraction to the golfer while being large enough to allow the imaging units to track the motion of the golfer's body.

According to one aspect, it may be desirable to attach the markers to different parts of the player's body using, for example, a double-sided tape or an elastic band, as shown in FIG. 1. However, other methods known to those skilled in the art may be used. Regardless of the method used to attach the markers, it is preferred that they are attached in a manner that minimizes the physical and visual distraction to the golfer, i.e., the markers substantially minimize the restriction on a golfer's movement and they do not visually distract the golfer. Moreover, it is desirable for the markers to be attached to the golfer such that their position is substantially fixed relative to the golfer, i.e., their placement on the golfer's body does not change substantially.

In one embodiment, the IR markers may be selectively positioned on the golfer's body and the golf club and golf ball. Alternately, one or more IR markers may be selectively positioned on at least one of the golfer, the golf club, and the golf ball. The markers may be selectively positioned on the golfer's body in order to determine desired body movement characteristics, such as motion of the lower body, trunk, arms, wrists, hands, head, feet, and the like. For instance, in one embodiment the markers may be positioned on the golfer's feet, shin, calf, thigh, biceps, top of the spine, bottom of the spine, elbows, knees, hands, and head. In addition, the markers may be selectively positioned on apparel that the golfer wears, such as gloves, shoes, hats, or other clothing. All of the markers may not be visible to the IR detector at all times, i.e., some markers may be invisible to the camera before the golfer begins to swing the club, but may become visible for a period of time during or after the swing. This may occur, for example, with markers positioned at the top and bottom of the golfer's spine. In this case, the markers would not be visible until after the golfer swings the golf club and follows through (for ideal body movement while swinging a golf club).

According to one embodiment, a kinematic analysis of the golfer's body may be performed while the golfer stands on a platform 20, as shown in FIG. 1. It is desirable for the platform to be substantially level and flat, and it is preferably large enough to allow room for the golfer to move around without leaving the platform 20. The platform 20 may include a force platform 22 on which the golfer may stand. The force platform 22 preferably comprises at least two plates 24, 26 generally positioned such that each of the golfer's feet can be placed comfortably on a separate plate 24, 26. It is desirable for the force platform 22 to employ inverse kinetics to use the weight placement and/or shift of the golfer to aid in determining the movement of the golfer's body parts, e.g., the knees, hips, and shoulders. When the present invention is used outdoors, a portable platform may be used. The portable platform may also include force plates 24, 26.

When the present invention is used indoors, the platform is about 5'×5' or greater. More preferably, the platform is about 10'×10' or greater, and most preferably the platform is about 20'×20' or greater. In other embodiments, however, the present invention may be used outdoors, e.g., on a golf course or driving range. In situations where the platform is used outdoors, the platform may be smaller in order to improve portability. The platform may comprise two or more pieces, or it may be foldable or otherwise collapsible to allow it to be easily transported. Preferably, the outdoor platform is about 6'×6' or smaller. More preferably, the outdoor platform is about 5'×5' or smaller. Most preferably, the outdoor platform is about 4'×4' or smaller.

Because the present invention includes the ability to be used in a variety of situations, e.g., indoors or outdoors, it may be desirable to include a protective shield that prevents light from directly shining on the golfer, the golf club, or the golf ball. This may be especially important when the present invention is used outdoors because natural light, e.g., sunlight, may interfere with a camera's detection of the IR markers. Therefore, the present invention may include a protective shield that prevents direct light from interfering with the detection of the IR markers. Those skilled in the art will appreciate that the protective shield can be fashioned in a variety of manners, and may include any desired dimensions or materials. It is preferable, however, for the protective shield to be configured and dimensioned to prevent interference with the golfer's swing or line of sight.

Figure 2:
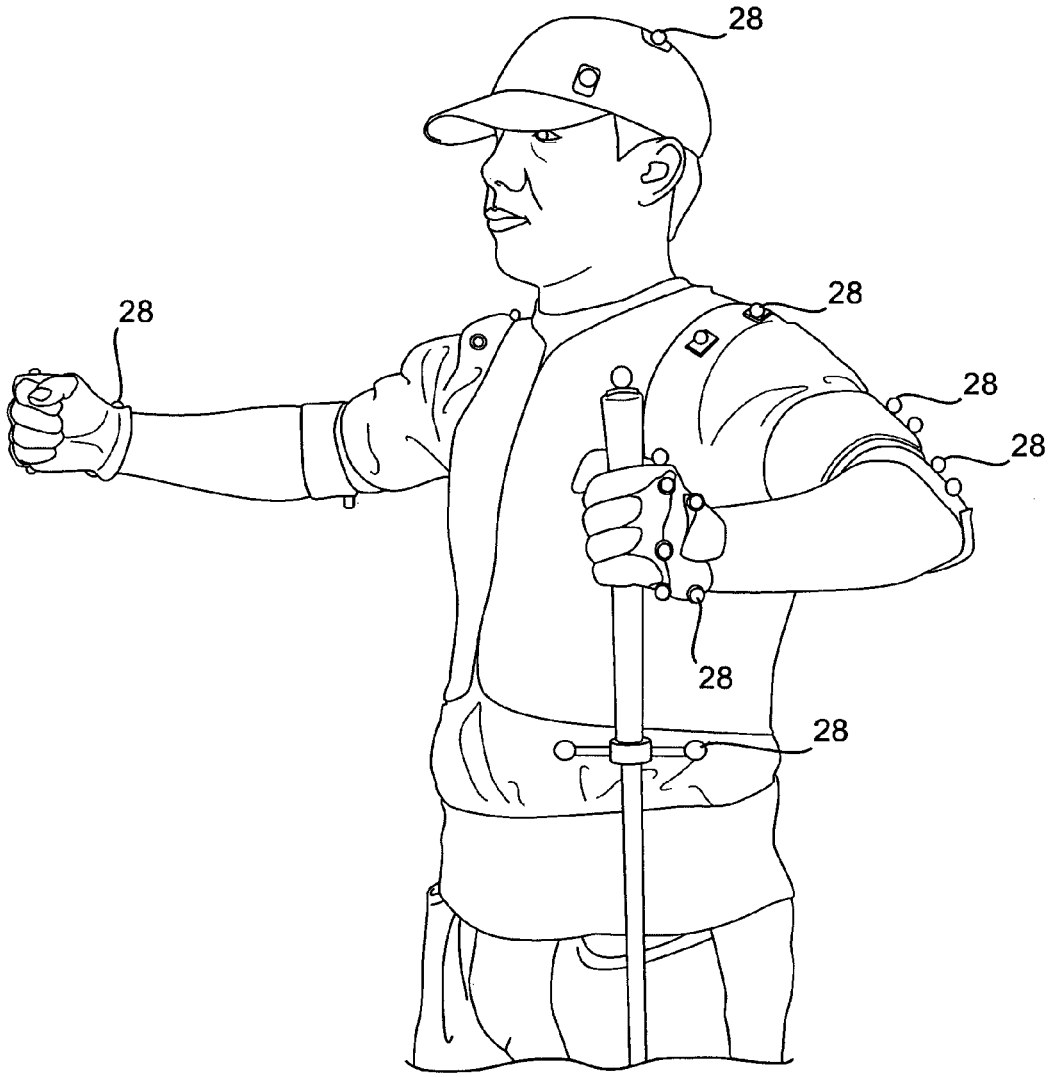
FIGS. 2-4 are diagrams showing markers positioned on a golfer according to one embodiment of the present invention.
Figure 3:
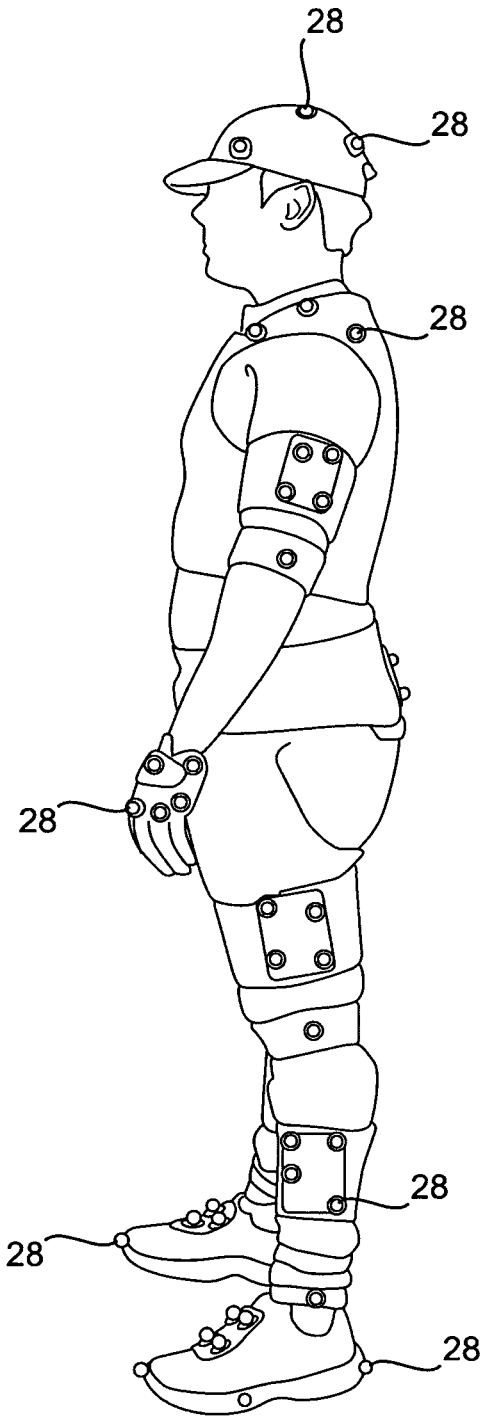
Figure 4:
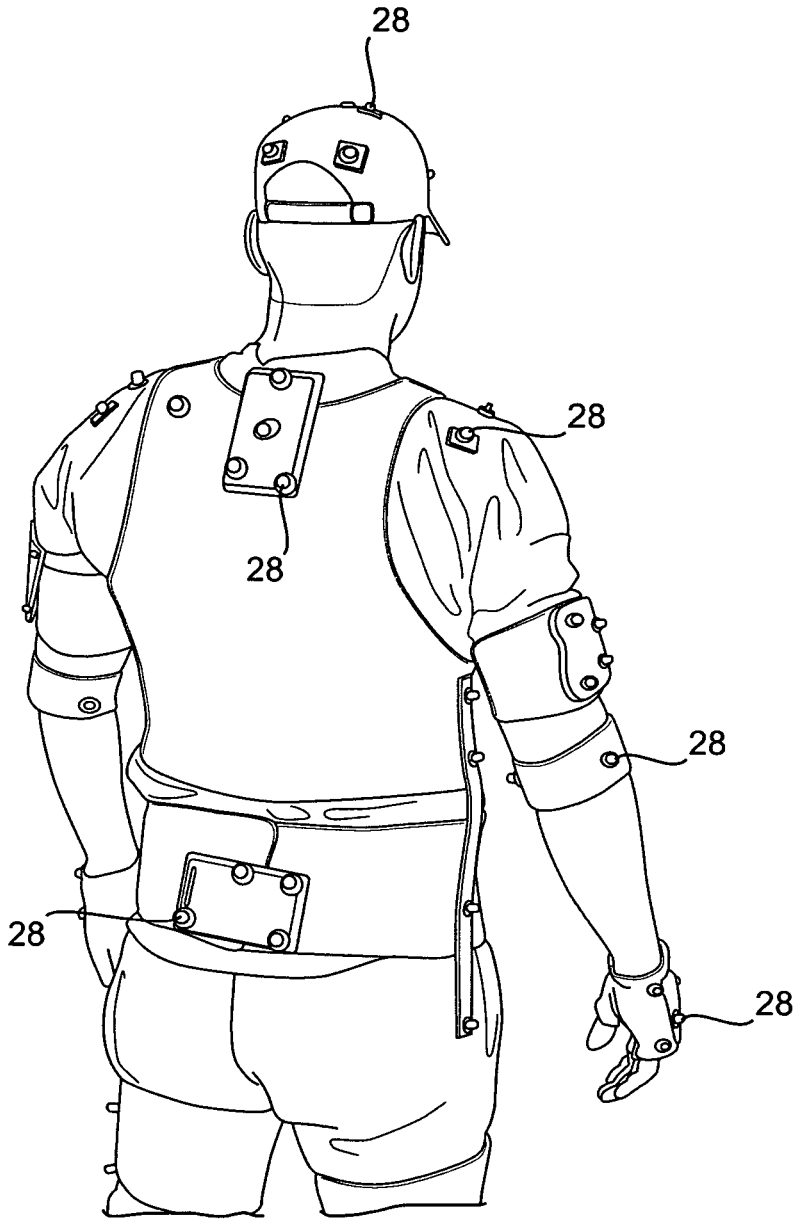

According to the method of the present invention, a plurality of markers are selectively positioned at various points on the golfer's body, as illustrated in FIGS. 2-4. The markers 28 are positioned such that some are placed on rigid parts of the body, e.g., the arms, thighs, calves, or legs, and others are positioned at the joints, e.g., the elbow, knees, or wrists. Once the plurality of markers 28 have been positioned on the golfer's body, a "static calibration" may be performed.

In one embodiment, the static calibration involves the golfer assuming one or more predetermined positions, an example of which is shown in FIG. 2. Preferably, the present invention is capable of tracking the markers on different parts of the body, i.e., an operator may program software being run by the processor to recognize and track the markers as belonging to a particular part of the body, e.g., the shin, arm, etc. Any rigid position may be used, and may be determined according to the placement of the markers or the measurements that are desired. The IR illuminator(s) may be activated one or more times for each rigid position, and the image acquisition devices preferably acquire images of the plurality of IR markers.

One advantage of using a static calibration is that the relationship between different markers, and therefore different body parts, may be determined. That is, the markers were previously placed at a plurality of known, predetermined points on the golfer's body. By acquiring images of the markers when the golfer assumes one or more rigid positions, i.e., when the golfer is substantially motionless, the computer is able to determine and digitize the position of the rigid bodies and joints, and their position relative to one another.

After the static calibration is performed, the markers positioned at the joints may be removed. Some of the markers positioned at rigid points on the body are preferably maintained in their position. Thus, another advantage of performing the static calibration first is that the golfer is not required to have an excessive number of markers positioned on his or her body when their movement and swing is being analyzed. This reduces the distraction to the golfer, and increases the reliability and accuracy of the analysis because the impediments to the golfer's motion are substantially minimized.

After the desired markers are removed, the golfer steps into the field of view of the image acquisition devices, e.g., the cameras, and the IR illuminators. In some embodiments, the golfer may also be stepping onto a platform 20 which may optionally include one or more force plates 24,26. After the golfer positions himself within the field of view of the present invention, he or she may position a golf ball as desired, and then swing the golf club and strike the ball. The trigger of the present invention determines when the golfer initiates the swing, which will initiate image acquisition. This method of acquiring images is well known to those skilled in the art, and is described in U.S. patent's described above and incorporated herein by reference. The process of swinging a golf club and striking the golf ball may be repeated as many times as desired. After each swing, images of at least one of the golfer, golf club, and golf ball are acquired. The images are then processed and stored in a memory. In this manner, a kinematic analysis of the golfer, golf club, and golf ball may be determined.

Figure 5:
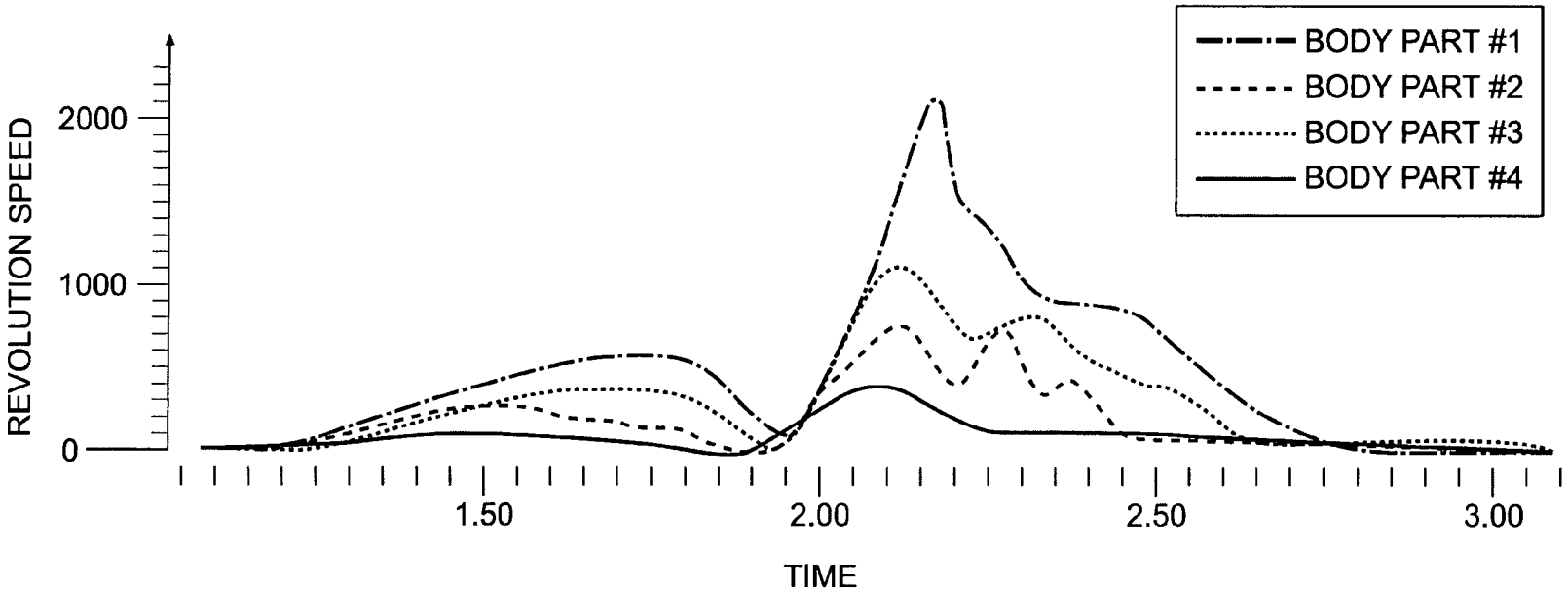
FIG. 5 is a graph showing a plot of the body movement of a golfer according to one embodiment of the present invention.

As mentioned above, the present invention analyzes the acquired images to determine the body movement of the golfer. Analyzing images to determine kinematics is well known to those skilled in the art, and is described in the U.S. patent's described above and incorporated herein by reference. Preferably, the analysis yields information about body movement including, but not limited to, timing, rotational velocity, speed, and translation. One advantage of the present invention is that the body movement of each individual part of the body with respect to other parts of the body may be determined and plotted for analysis. For example, in one embodiment the present invention is capable of determining the rotational velocity of the various parts of the player's body. This may be achieved, for instance, by analyzing the movement of the images of the IR markers. FIG. 5 is a graph showing the rotational velocity of various body parts as a function of time. Specifically, FIG. 5 shows the rotational speed of the lower body, trunk, arms, and grip of the club with respect to time. The present invention includes the ability to color code, or otherwise distinguish between, various body parts shown on the graph. In addition, the rotational speed of these body parts can be seen with respect to one another. This allows an analysis of the timing of the movement of different body parts to be performed.

For example, if it is desirable for the shoulders and arms to move at substantially the same time during a club swing, the present invention can determine if the movement of these two body parts occurs in that manner. This may be implemented by the processor, which can calculate any difference in the timing of the movement of these two body parts. Similarly, the rotational speed, translation, or any other kinematic aspect of the golfer may be compared. A golfer may then use the comparison to spot weaknesses in their swing, which they may then attempt to alter through practice.

In one embodiment, the golfer's rotational speed, as shown in FIG. 5, may be compared to the rotational speed of a technically perfect golfer in order to determine how the golfer can improve their body movement. Rather, the present invention is preferably capable of measuring the movement of one or more technically perfect golfers to serve as a reference point for golfers to compare themselves with. It may be desirable to analyze the movement of more than one golfer, for example, to allow the kinematic characteristics of each of their body parts to be averaged. One advantage of using several different players is that the averaged movement may be closer to the "ideal" body movement of a golfer. Moreover, the present invention also includes the ability to compare the movement of the golfer with respect to the reference point, and to generate a detailed analysis that a golfer may use to determine how they can modify their body motion to improve their swing. In particular, if a golfer's rotational speed is being evaluated, it may be compared to the rotational speed of the reference point and an analysis may be generated, e.g., the percentage that the rotational speed exceeds or fails to meet the target rotational speed, a comparison of the timing of the golfer's lower body movement relative to their trunk movement compared to the timing of the reference point's lower body movement relative to the trunk movement. Of course, these are just examples. Those skilled in the art will appreciate that a variety of analyses may be performed as desired for a particular application, or as desired by a golfer.

The present invention also includes the ability to correlate the kinematic analysis of the movement of a golfer's body with the kinematic analysis of the golfer's swing and ball trajectory. In other words, the movement of different parts of the golfer's body may be determined in the manner described above. Then, an analysis of the swing of the golf club, and the resultant ball trajectory, may be determined. The movement of the individual parts of the golfer's body may then be associated with the movement of the golf club. This may be implemented, for example, using software run by the processor.

The utility of this feature of the present invention is further enhanced by acquiring images of the golfer swinging several different times. Then, the data from each of the swings may be compared to one another in order to determine how changes in body movement influence the club swing and ball trajectory. A comparison of the data from two or more of the golfer's swings can yield data including the effect of the timing of the movement of the golfer's body parts on the golf club swing, the effect of the translation of the golfer's body parts on the golf club swing, the effect of the rotational velocity of the golfer's body parts on the golf club swing, the effect of the speed of the golfer's body parts on the golf club swing, and the like.

For example, as described above, the rotational speed of various parts of the golfer's body, e.g., the lower body, trunk, arms, and hands, may be determined, as illustrated in FIG. 5. A kinematic analysis of the golf club and golf ball may also be determined, and then correlated with the golfer's body movement. The data analysis of the rotational speed of the golfer's body parts, the club swing, and the ball trajectory may then be compared to an ideal golfer's rotational speed, club swing, and ball trajectory. Preferably, this type of analysis and comparison allows a golfer to determine how he/she could modify their body movement to result in an ideal club swing and ball trajectory.

Comparing two or more of the golfer's swings may also yield useful information. According to one aspect, the rotational velocity of the golfer's body parts and the kinematic analysis of the resultant club swing and ball trajectory for two or more swings may be compared. This type of comparison allows the present invention to determine how increasing, decreasing, or holding constant the rotational speed of their lower body affects their swing. In this manner, a golfer can see, for example, how modifying the rotational speed of their body changes their club swing speed. Skilled artisans will understand that the rotational speed is just one example of the many body movement characteristics that may be analyzed. Other characteristics, such as timing and translation, may be analyzed as desired.

Increasingly, golfers are realizing that their physical conditioning, e.g., strength, cardiovascular fitness, and flexibility, can influence their club swing. Because of this realization, professionals and amateurs desire the ability to find exercises and fitness regimens that can improve their overall fitness level. According to one aspect, the present invention includes the ability to correlate the kinematic analysis of the golfer's body movement, club swing, and ball trajectory with their physical attributes. For instance, if the rotational velocity of a golfer's trunk is slower than desired, or the timing of the trunk movement is not ideal, it may be desirable for the golfer to perform exercises that increase their strength or flexibility in this area of their body. As such, a workout plan that improves these weaknesses may be generated for the golfer. One example of a system and method with which the present invention may be used to generate a workout plan is described in U.S. patent application Ser. No. 11/228,349, the entirety of which is incorporated herein by reference.

According to this aspect of the present invention, a plurality of markers may be positioned on the golfer, as described above. In a similar manner as described above, a static calibration may be performed, e.g., to determine the relationship between the different markers placed on the golfer's body. Then, the markers positioned at the joints may be removed, and some of the markers positioned at rigid points on the body may be maintained in their position. As described in U.S. patent application Ser. No. 11/228,349, a golfer may then perform a plurality of fitness tests designed to assess the physical fitness level of the golfer. While these fitness tests are being performed, the present invention may be used to acquire images of the golfer. The fitness tests may include range of motion tests. Examples of fitness tests that may be performed include, but are not limited to, a toe touch, deep squat, seated trunk rotation, hip rotation while the golfer is lying on his/her back, a single leg balance test, a pelvic tilt test, a single leg bridge test, a side bridge test, a supine latissimus dorsi test, a reach, roll, and lift test, an open book test, and a shoulder rotation 90/90 test.

After images of the golfer have been acquired, the images of each of these tests may be analyzed to determine any desired information. For instance, if a golfer is performing a toe touch fitness test, an image may be analyzed to determine how close the golfer is able to get to actually touching his/her toes. This analysis may then be used in generating a workout plan, e.g., the workout plan may require the golfer to perform one or more exercises that improve the flexibility of their hamstrings. Those skilled in the art will recognize that this is just one example of an image analysis. A variety of alternate analysis known to skilled artisans may be used in accordance with the present invention.

In order to generate a workout plan, it may also be desirable for a golfer's swing and/or posture to be analyzed. In one embodiment, the present invention may be used, in the manner described herein, to acquire images of the golfer performing a swing and/or demonstrating his/her posture or golf stance. Once the images have been acquired, they may be analyzed to determine aspects of the golfer's stance and/or the kinematics of their swing. This information may then be used alone, or in combination with the analysis of the fitness tests, to generate a workout plan.

Although the present invention has been described with reference to particular embodiments, it will be understood to those skilled in the art that the invention is capable of a variety of alternative embodiments within the spirit of the appended claims. For example, the present invention may be used to perform a kinematic analysis of the body movement of athletes that participate in any sport including, but not limited to, baseball, hockey, basketball, football, tennis, soccer, swimming, track and field, boxing, skiing, snowboarding, skateboarding, and field hockey. Moreover, the present invention may be used to correlate the kinematic analysis of the athlete's body movement with a kinematic analysis of the particular equipment being used, such as a baseball, tennis racket, football, soccer ball, or field hockey stick.

The invention claimed is:

1. A computer-implemented method for analyzing a golfer's body movement, comprising:

selectively positioning a plurality of markers on a golfer;

using a processor, selectively connectable to a memory and an image acquisition system to acquire a first set of one or more images of the golfer, wherein the images are acquired when the golfer is substantially motionless;

removing some of the plurality of markers from the golfer;

using the processor to acquire a second set of one or more images of a golfer after the removal of some of the plurality of markers, wherein the golfer is in motion at least part of the time during the second set of image acquisition; and using the processor to compare the movement of two or more body parts of the golfer using the second set of one or more images.

2. The method according to claim 1, wherein the selectively positioning comprises at least one of:

selectively positioning a plurality of infrared markers at the joints and the rigid body parts of the golfer; and selectively positioning one or more infrared markers on at least one of a golf club and a golf ball.

3. The method according to claim 2, wherein the removing comprises removing the infrared markers positioned at golfer's joints.

4. The method according to claim 2, wherein the acquiring the first set of one or more images comprises:

acquiring one or more images of the golfer in a plurality of predetermined, fixed positions; and using the one or more acquired images to determine the relationship between the golfer's joints and the rigid body parts of the golfer.

5. The method according to claim 2, wherein the acquiring the second set of one or more images comprises:

the golfer performing one or more golf club swings; and acquiring images of at least one of the golfer and the golf club before, during, and after the one or more golf club swings.

6. The method according to claim 5, wherein the comparing comprises:

analyzing the second set of acquired images to determine the movement of two or more of the golfer's body parts; and determining a correlation between the movement of the two or more body parts and the golfer's one or more club swings.

7. The method according to claim 6, wherein the determining the correlation comprises determining at least one of:

the timing of the movement of the golfer's body parts;

the translation of the golfer's body parts;

the rotational velocity of the golfer's body parts; and the speed of the golfer's body parts.

8. A computer-implemented method for performing a kinematic analysis of a golfer's body, comprising:

selectively positioning a first plurality of infrared markers on a golfer;

using a processor, operatively connected to a memory, to execute computer program instructions to perform the following steps:

acquire images of the golfer, wherein at least some of the images are acquired when the golfer is substantially motionless and at least some of the images are acquired when the golfer is in motion;

analyze the kinematics of one or more body parts of the golfer using the acquired images; and correlate the kinematics of the golfer's one or more body parts with the kinematics of at least one of a golf club and a golf ball;

wherein the first plurality of infrared markers are positioned on the golfer when they are substantially motionless and a second plurality of infrared markers are positioned on the golfer when they are in motion, wherein the first plurality of infrared markers is greater than the second plurality of infrared markers.

9. The method according to claim 8, further comprising selectively positioning one or more infrared markers on at least one of the golf club and the golf ball.

10. The method according to claim 8, wherein the selectively positioning comprises positioning one or more markers on the back of the golfer.

11. The method according to claim 8, wherein the acquiring images comprises acquiring images of the golfer before, during, and after two or more golf club swings.

12. The method according to claim 11, wherein the analyzing comprises determining the motion of the golfer's one or more body parts relative to one another.

13. The method according to claim 12, wherein the correlating comprises:

correlating the motion of the golfer's one or more body parts and the resulting motion of the golf club for each of the two or more golf club swings; and comparing the correlation for each of the two or more golf club swings.

14. The method according to claim 13, wherein the comparing comprises determining at least one of:

the effect of the timing of the movement of the golfer's body parts on the golf club swing;

the effect of the translation of the golfer's body parts on the golf club swing;

the effect of the rotational velocity of the golfer's body parts on the golf club swing; and the effect of the speed of the golfer's body parts on the golf club swing.

15. A computer-implemented method for performing a kinematic analysis of a golfer's body, comprising:

selectively positioning a plurality of markers on a golfer and a golf club;

using a processor to perform the following steps:

acquire images of the plurality of markers before and after the golfer swings the golf club, wherein the golfer swings the golf club two or more times; and determine the correlation between the movement of the golfer's body parts and the golfer's club swings based on the acquired images of the plurality of markers;

wherein a first plurality of images are acquired while the golfer has a first plurality of markers positioned on the golfer's joints and rigid body parts and a second plurality of images are acquired while the golfer has a second plurality of markers positioned only on the golfer's rigid body parts.

16. The method according to claim 15, wherein the plurality of markers comprise infrared markers.

17. The method according to claim 16, wherein the acquiring comprises:

acquiring images of the golfer, wherein the golfer is substantially motionless;

determining the relationship between the golfer's body parts using the acquired images;

removing some of the infrared markers; and acquiring a second set of images of the golfer, wherein the images are acquired before, during, and after the golfer swings the golf club.

18. The method according to claim 16, wherein the using comprises:

correlating the movement of the golfer's body parts with the movement of the golf club; and comparing the correlation for each of the two or more golf club swings.

19. The method according to claim 18, wherein the comparing comprises determining at least one of:

the effect of the timing of the movement of the golfer's body parts on the golf club swing;

the effect of the translation of the golfer's body parts on the golf club swing;

the effect of the rotational velocity of the golfer's body parts on the golf club swing; and the effect of the speed of the golfer's body parts on the golf club swing.

20. The method according to claim 16, wherein the using comprises:

correlating the movement of the golfer's body parts with the movement of the golf club to yield golfer data; and comparing the golfer's data with an ideal golfer's data.

21. The method according to claim 15, wherein the acquiring comprises using the acquired images to generate a workout plan.

* * * * *